US005870658A

United States Patent [19]

Goto et al.

[11] Patent Number: 5,870,658

[45] Date of Patent: Feb. 9, 1999

[54] DEVELOPING DEVICE AND REGULATING MEMBER

[75] Inventors: Hiroshi Goto, Itami; Shuichi Nakagawa, Suita; Yoichi Fujieda, Nishinomiya; Ryuji Inoue, Itami, all of Japan

[73] Assignee: Minolta Co., Ltd., Osaka, Japan

[21] Appl. No.: 69,171

[22] Filed: Apr. 29, 1998

[30] Foreign Application Priority Data

May 8, 1997 [JP] Japan ..... 9-118187

[51] Int. Cl.[6] ..... G03G 15/08

[52] U.S. Cl. ..... 399/284; 399/285

[58] Field of Search ..... 399/284, 285, 399/286, 279, 274, 265, 252

[56] References Cited

U.S. PATENT DOCUMENTS

| | | | |
|---|---|---|---|
| 5,168,312 | 12/1992 | Aoto et al. | 399/284 |
| 5,170,213 | 12/1992 | Yamaguchi et al. | 399/281 |
| 5,682,585 | 10/1997 | Yamaguchi et al. | 399/274 |
| 5,741,616 | 4/1998 | Hirano et al. | 399/286 X |

FOREIGN PATENT DOCUMENTS

| | | |
|---|---|---|
| 62-19749 | 4/1987 | Japan . |
| 63-55709 | 11/1988 | Japan . |
| 7-9552 | 2/1995 | Japan . |

*Primary Examiner*—Arthur T. Grimley
*Assistant Examiner*—Hoan Tran
*Attorney, Agent, or Firm*—Burns, Doane, Swecker & Mathis, LLP

[57] ABSTRACT

The present invention is directed to a developing device using a developer carrying member in which an insulating layer is formed on the surface of a conductive base substrate for regulating, in conveying a developer to a developing area opposite to an image carrying member with it being held on the surface of the developer carrying member, the amount of the developer conveyed to the developing area upon pressing a regulating member against the surface of the developer carrying member, wherein a regulating member in which a dielectric layer satisfying the following relationship (1) is formed on an electrical conductive member is used as the regulating member, to press the dielectric layer against the developer carrying member:

$$t/\epsilon \geqq 10 \quad (1)$$

where t ($\mu$m) is the thickness of the dielectric layer, and $\epsilon$ is the relative dielectric constant of the dielectric layer.

13 Claims, 7 Drawing Sheets

DEVELOPING DEVICE AND REGULATING MEMBER

BACKGROUND OF THE INVENTION

This application is based on application No. 118187/1997 filed in Japan, the contents of which is hereby incorporated by reference.

FIELD OF THE INVENTION

The present invention relates generally to a developing device used for developing a latent image formed on an image carrying member in an image forming apparatus such as a copying machine or a printer and a regulating member used for the developing device, and more particularly, to a developing device so adapted as to convey a developer to a developing area opposite to an image carrying member with it being held on the surface of a developer carrying member as well as to regulate the amount of the developer thus conveyed to the developing area by a regulating member.

DESCRIPTION OF THE RELATED ART

In an image forming apparatus such as a copying machine or a printer, various developing devices have been conventionally used for developing a latent image formed on an image carrying member. As such a developing device, a developing device using a monocomponent developer containing no carrier particles has been known in addition to a developing device using a two-component developer containing carrier particles and toner particles.

Widely utilized as the above-mentioned developing device using a monocomponent developer is one so adapted that a developer is conveyed to a developing area opposite to an image carrying member with it being held on the surface of a developer carrying member, and a regulating member is pressed against the surface of the developer carrying member while the developer is being thus conveyed to the developing area, to regulate the amount of the developer conveyed to the developing area by the regulating member as well as to frictionally charge the developer.

Various improvements have been conventionally achieved with respect to the above-mentioned developing device containing a monocomponent. It has been proposed that a developer carrying member in which an insulating layer is provided on the surface of a conductive base substrate is used as the above-mentioned developer carrying member for the purpose of effectively charging a developer, preventing fine powder of the developer from being accumulated on the surface of a developer carrying member, and enhancing the developing characteristics of a line image, for example, as disclosed in Japanese Patent Publication No. 19749/1987, Japanese Patent Publication No. 55709/1988, and Japanese Patent Publication No. 9552/1995, for example.

When development is performed for a long time using the developer carrying member in which the insulating layer is thus provided on the surface of the conductive base substrate, the amount of the developer conveyed to the developing area opposite to the image carrying member with it being held on the surface of the developer carrying member is made non-uniform, so that the density of a formed image is made non-uniform, for example.

SUMMARY OF THE INVENTION

An object of the present invention is to make it possible for a regulating member to suitably regulate, even when development is performed for a long time using a developer carrying member in which an insulating layer is provided on the surface of a conductive base substrate, the amount of a developer conveyed to a developing area by the developer carrying member.

Another object of the present invention is to prevent, even when development is performed for a long time using a developer carrying member in which an insulating layer is provided on the surface of a conductive base substrate, the amount of a developer conveyed to a developing area opposite to an image carrying member with it being held on the surface of the developer carrying member from being made non-uniform, to stably obtain a good image whose density is uniform, for example.

The inventors and the others have examined the cause of non-uniformity occurring in the amount of a developer conveyed to a developing area opposite to an image carrying member with it being held on the surface of a developer carrying member in which an insulating layer is provided on the surface of a conductive base substrate as described above in a case where development is performed for a long time using the developer carrying member.

As a result, the following conclusions have been drawn.

When a regulating member is pressed against the surface of a developer carrying member provided with an insulating layer, to regulate the amount of a developer conveyed to a developing area as well as to charge the developer, charge having the opposite polarity to the charging polarity of the developer (counter charge) is left and stored in the insulating layer on the surface of the developer carrying member. The electric field strength between the developer carrying member and the regulating member is increased, causing a partial leak by the counter charge thus stored in the insulating layer on the surface of the developer carrying member. The developer is not uniformly regulated by the regulating member due to the partial leak, so that the amount of the developer conveyed to the developing area by the developer carrying member is made non-uniform.

The present invention is directed to a developing device using a developer carrying member in which an insulating layer is formed on the surface of a conductive base substrate for regulating, in conveying a developer to a developing area opposite to an image carrying member with it being held on the surface of the developer carrying member, the amount of the developer conveyed to the developing area upon pressing a regulating member against the surface of the developer carrying member, wherein a regulating member in which a dielectric layer satisfying the following relationship (1) is formed on an electrically conductive member is used as the regulating member, to press the dielectric layer against the developer carrying member:

$$t\epsilon \geqq 10\ \mu m \tag{1}$$

where t ($\mu$m) is the thickness of the dielectric layer, and $\epsilon$ is the relative dielectric constant of the dielectric layer.

When the amount of the developer held on the surface of the developer carrying member provided with the insulating layer is regulated and the developer is charged by the dielectric layer provided in the regulating member, an electric field between the developer carrying member and the regulating member is prevented from being raised by the dielectric layer provided in the regulating member even if charge having the opposite polarity to the charging polarity of the developer is left and stored in the insulating layer on the surface of the developer carrying member.

Even if the charge having the opposite polarity to the charging polarity of the developer is left and stored in the insulating layer on the surface of the developer carrying member, therefore, a partial leak is prevented from occurring between the developer carrying member and the regulating member, thereby eliminating the possibility that the developer is not uniformly regulated by the regulating member, so that the developer held on the surface of the image carrying member is conveyed to the developing area upon being uniformly regulated by the regulating member.

When the dielectric layer in the regulating member is composed of a material having approximately the same triboelectric charging properties in a triboelectric series as those of the developer, the developer is hardly frictionally charged by the friction of the regulating member against the dielectric layer. However, charge having the opposite polarity to the charging polarity of the developer is prevented from being stored in the dielectric layer. Therefore, the developer is prevented from being welded upon being drawn to the regulating member, so that the developer can be stably regulated by the regulating member.

On the other hand, the dielectric layer in the regulating member is composed of a material having different triboelectric charging properties in a triboelectric series from those of the developer, the developer is sufficiently frictionally charged by the regulating member, while charge having the opposite polarity to the charging polarity of the developer is stored in the dielectric layer in the regulating member, so that the developer may be welded to the regulating member.

When the dielectric layer in the regulating member satisfies the following relationship (2), and an electric field for feeding the developer from the regulating member to the developer carrying member is exerted on a portion between the regulating member and the developer carrying member, the developer is prevented from being drawn to the regulating member, and is prevented from being welded to the regulating member, so that the developer can be stably regulated by the regulating member:

$$100\ \mu\text{m} \geqq t/\epsilon \geqq 10\ \mu\text{m} \quad (2)$$

where t ($\mu$m) is the thickness of the dielectric layer, and $\epsilon$ is the relative dielectric constant of the dielectric layer.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
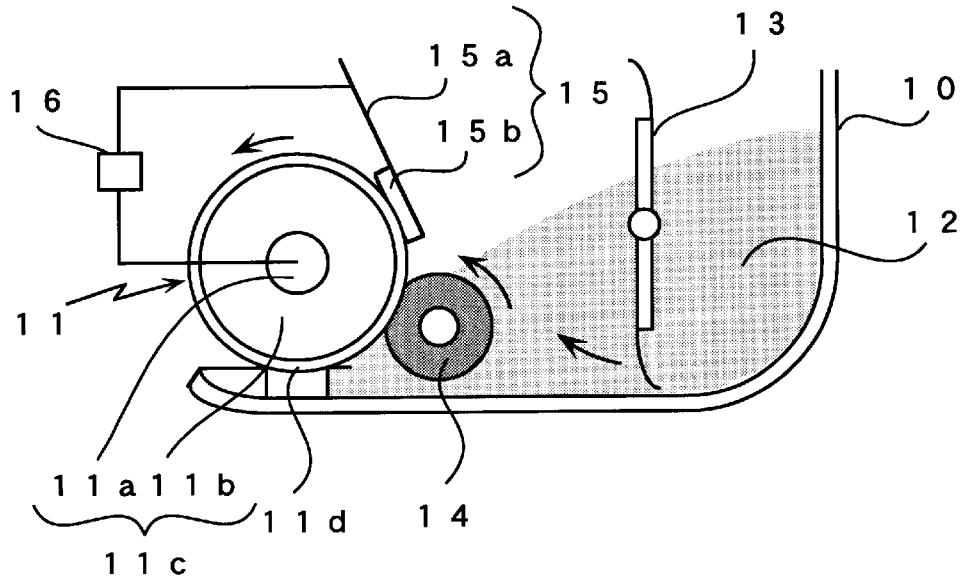
FIG. 1 is a schematic cross-sectional view of a developing device according to an embodiment of the present invention.

A developing device according to a preferred embodiment of the present invention will be specifically described on the basis of the drawings.

In a developing device according to the present embodiment, an example of a developer carrying member 11 is one in which an insulating layer 11*d* is formed on the surface of a conductive base substrate 11*c* in which an elastic layer 11*b* having conductive properties is provided around a rotating shaft 11*a* having conductive properties.

An example of the insulating layer 11*d* provided in the developer carrying member 11 is one having a specific volume resistivity of not less than $10^{12}$ Ω·cm, for example, various types of resin materials such as nylon and rubber materials.

In the developing device, a developer (toner particles) 12 is contained in the main body of the developing device provided with the developer carrying member 11, and a feeding blade 13 is provided therein. The feeding blade 13 is rotated, to feed the developer 12 to a feeding roller 14 provided so as to come into contact with the developer carrying member 11, and the developer 12 is supplied to the surface of the developer carrying member 11 by the feeding roller 14. The developer 12 is held on the surface of the developer carrying member 11, and the developer 12 is conveyed to a developing area opposite to an image carrying member (not shown) by rotating the developer carrying member 11.

While the developer 12 is being thus conveyed to the image carrying member by the developer carrying member 11, a regulating member 15 is pressed against the surface of the developer carrying member 11, to regulate the amount of the developer 12 conveyed to the developing area as well as to frictionally charge the developer 12 by the regulating member 15.

Figure 2:
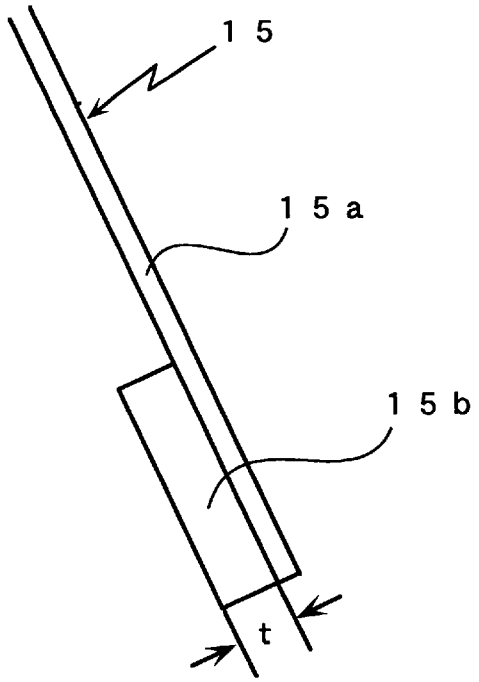
FIG. 2 is an enlarged explanatory view of a regulating member used in the developing device according to the embodiment.

An example of the regulating member 15 is one in which a dielectric layer 15*b* is provided in a portion in contact with the surface of the developer carrying member 11 in an electrically conductive member 15*a* formed in a plate shape of stainless, phosphor bronze, or the like, as shown in FIGS. 1 and 2. As the dielectric layer 15*b*, the thickness t ($\mu$m) of the dielectric layer 15*b* divided by the relative dielectric constant thereof $\in$ (t/$\in$) is set to not less than 10. Further, a DC voltage Vb is applied from a power supply 16 to a portion between the developer carrying member 11 and the regulating member 15 as required, to further suitably charge the developer 12. As a material composing the dielectric layer 15*b*, it is possible to use various plastic materials, elastomer materials, and rubber materials.

The developer 12 charged upon being regulated by the regulating member 15 is conveyed to the developing area opposite to the image carrying member by the developer carrying member 11, and the developer is supplied to an electrostatic latent image formed on the image carrying member, to perform development.

When the regulating member 15 provided with the dielectric layer 15*b* as described above is pressed against the surface of the developer carrying member 11 provided with the insulating layer 11*d*, to regulate the amount of the developer 12 on the surface of the developer carrying member 11 as well as to charge the developer 12, there is no possibility that the developer 12 is not uniformly regulated by the regulating member 15 even in a case where development is performed for a long time period, so that the developer held on the surface of the developer carrying member 11 is conveyed to the developing area upon being uniformly regulated by the regulating member 15.

It will be made clear by taking an experimental example that in the developing device according to the present embodiment, there is no possibility that the developer 12 is not uniformly regulated by the regulating member 15 even when development is performed for a long time period, so that the developer 12 held on the surface of the developer carrying member 11 is conveyed to the developing area upon being uniformly regulated by the regulating member 15.

In this experimental example, toner particles mainly composed of polyester were used as the developer 12, while three types of regulating members 15 having dielectric layers 15*b* composed of a thermoplastic styrene elastomer having approximately the same triboelectric charging properties in a triboelectric series as those of the developer 12, having a relative dielectric constant $\epsilon$ of approximately 3 and respectively having thicknesses t of 10 $\mu$m, 100 $\mu$m, and 1000 $\mu$m provided in their electrically conductive members 15*a*, and a regulating member 15 provided with no dielectric layer 15*b* were used as the regulating member 15.

Each of the above-mentioned regulating members 15 was pressed against the surface of the developer carrying member 11 in a state where the developer 12 was supplied to the surface of the developer carrying member 11 provided with the insulating layer 11*d*, and no DC voltage Vb was applied to a portion between the developer carrying member 11 and the regulating member 15 from the power supply 16, and the developer carrying member 11 was rotated 1000 times while regulating the developer 12 held on the surface of the developer carrying member 11, to examine the state of the developer 12 on the surface of the developer carrying member 11.

As a result, in a case where the regulating members 15 provided with the dielectric layers 15*b* respectively having thicknesses t of 100 $\mu$m and 1000 $\mu$m and having the value t/$\in$ of not less than 10 $\mu$m were used, the developer 12 on the surface of the developer carrying member 11 was regulated in a uniform state.

On the other hand, in a case where the regulating member 15 provided with no dielectric layer 15*b* was used, a lot of stripe-shaped non-uniformities were presented in the developer 12 on the surface of the developer carrying member 11. Also in a case where the regulating member 15 provided with the dielectric layer 15*b* having a thickness t of 10 $\mu$m and having the value t/$\in$ of less than 10 $\mu$m was used, stripe-shaped non-uniformities were observed in the developer 12 on the surface of the developer carrying member 11.

In a state where the stripe-shaped non-uniformities were presented in the developer 12 on the surface of the developer carrying member 11 as described above, a DC voltage Vb of +500 V was applied to the regulating member 15 from the power supply 16. As a result, immediately after the developer 12 on the surface of the developer carrying member 11 was regulated by the regulating member 15 to which the DC voltage Vb of +500 V was thus applied, no non-uniformities in a stripe shape were presented. Thereafter, immediately after the DC voltage Vb was not applied to the regulating member 15, stripe-shaped non-uniformities were presented.

After the developer 12 adhering on the surface of the developer carrying member 11 was removed, and the surface of the developer carrying member 11 was then cleaned by alcohol, no stripe-shaped non-uniformities were observed in a certain time period even when the developer 12 on the surface of the developer carrying member 11 was regulated by the regulating member 15 provided with no dielectric layer 15*b*.

As a result, the cause of the above-mentioned stripe-shaped non-uniformities is considered a partial leak which occurred between the developer carrying member 11 and the regulating member 15 because counter charge having the opposite polarity to the charging polarity of the developer 12 was left and stored in the insulating layer 11*d* on the surface of the developer carrying member 11, and the electric field strength between the developer carrying member 11 and the regulating member 11 was increased.

Figure 3:
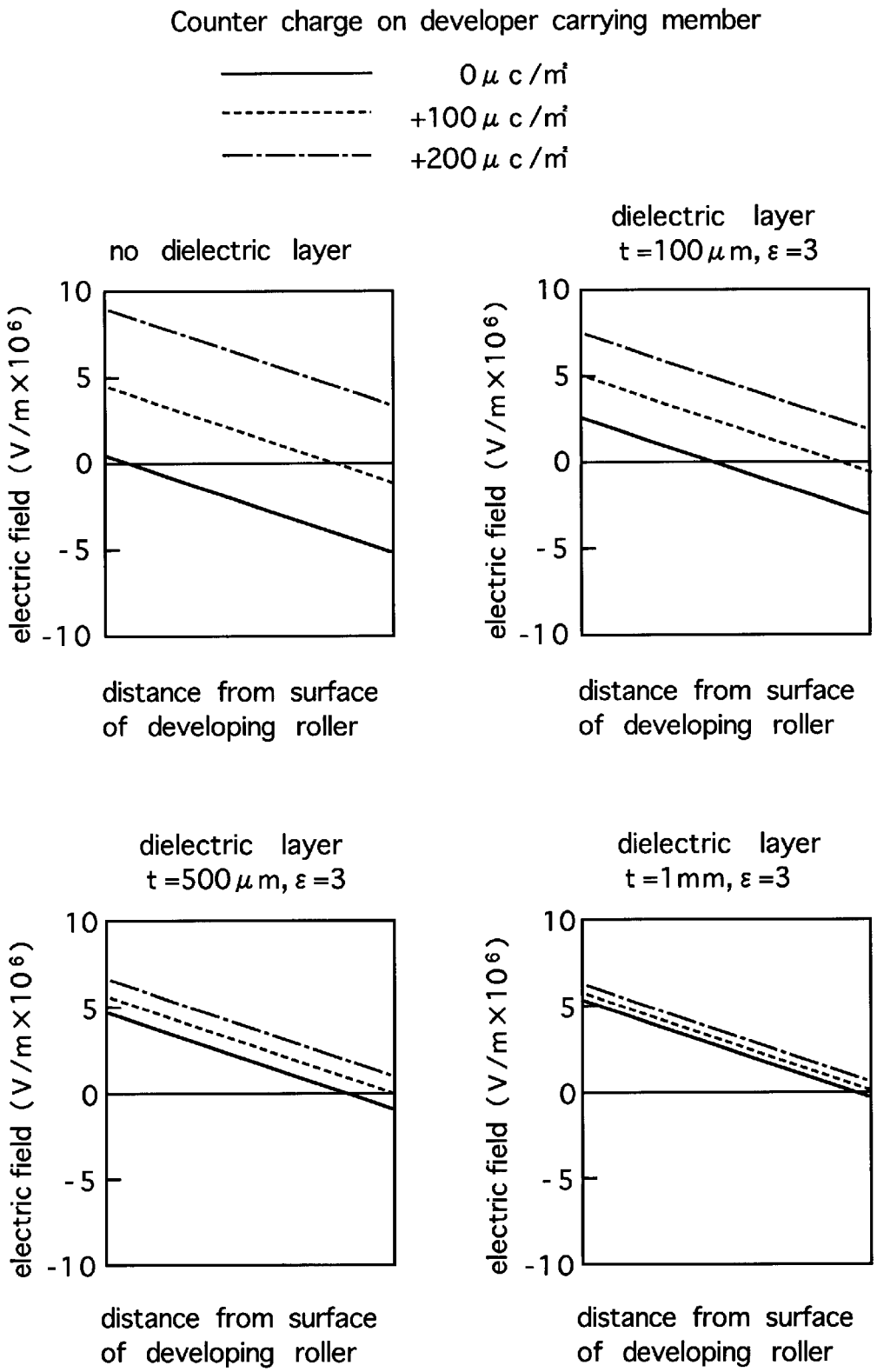
FIG. 3 is a diagram showing, in a case where regulating members provided with dielectric layers having a relative dielectric constant $\epsilon$ of approximately 3 and respectively having thicknesses t of 100 $\mu$m, 500 $\mu$m, and 1 mm are used, and counter charge on the surface of a developer carrying member is changed, the state of an electric field exerted on a portion between the regulating member and the developer carrying member.

Three types of regulating members 15 provided with dielectric layers 15*b* having a relative dielectric constant $\epsilon$ of approximately 3 and respectively having thicknesses of 100 $\mu$m, 500 $\mu$m, and 1 mm and the regulating member 15 provided with no dielectric layer 15*b* were used, to find the state of an electric field between the developer carrying member 11 provided with the insulating layer 11*d* and each of the regulating members 15 in a case where counter charge stored on the surface of the developer carrying member 11 was 0 $\mu C/m^2$, +100 $\mu C/m^2$, +200 $\mu C/m^2$. The results thereof were shown in FIG. 3.

As a result, the electric field was raised to the plus side as the counter charge on the surface of the developer carrying member 11 was increased. In a case where the regulating member 15 provided with no dielectric layer 15*b* was used, the electric field was greatly raised. When the counter charge was +200 $\mu C/m^2$, the electric field strength in the vicinity of the surface of the developer carrying member 11 was increased to the vicinity of $+10^7$ V/m, so that a leak was liable to occur between the developer carrying member 11 and the regulating member 15.

On the other hand, when the regulating member 15 provided with the dielectric layer 15*b* was used, the rise in the electric field with the increase in the counter charge was restrained as the thickness t of the dielectric layer 15*b* was increased. Even if the counter charge was increased to +200

$\mu C/m^2$, no leak occurred between the developer carrying member 11 and the regulating member 15.

Figure 4:
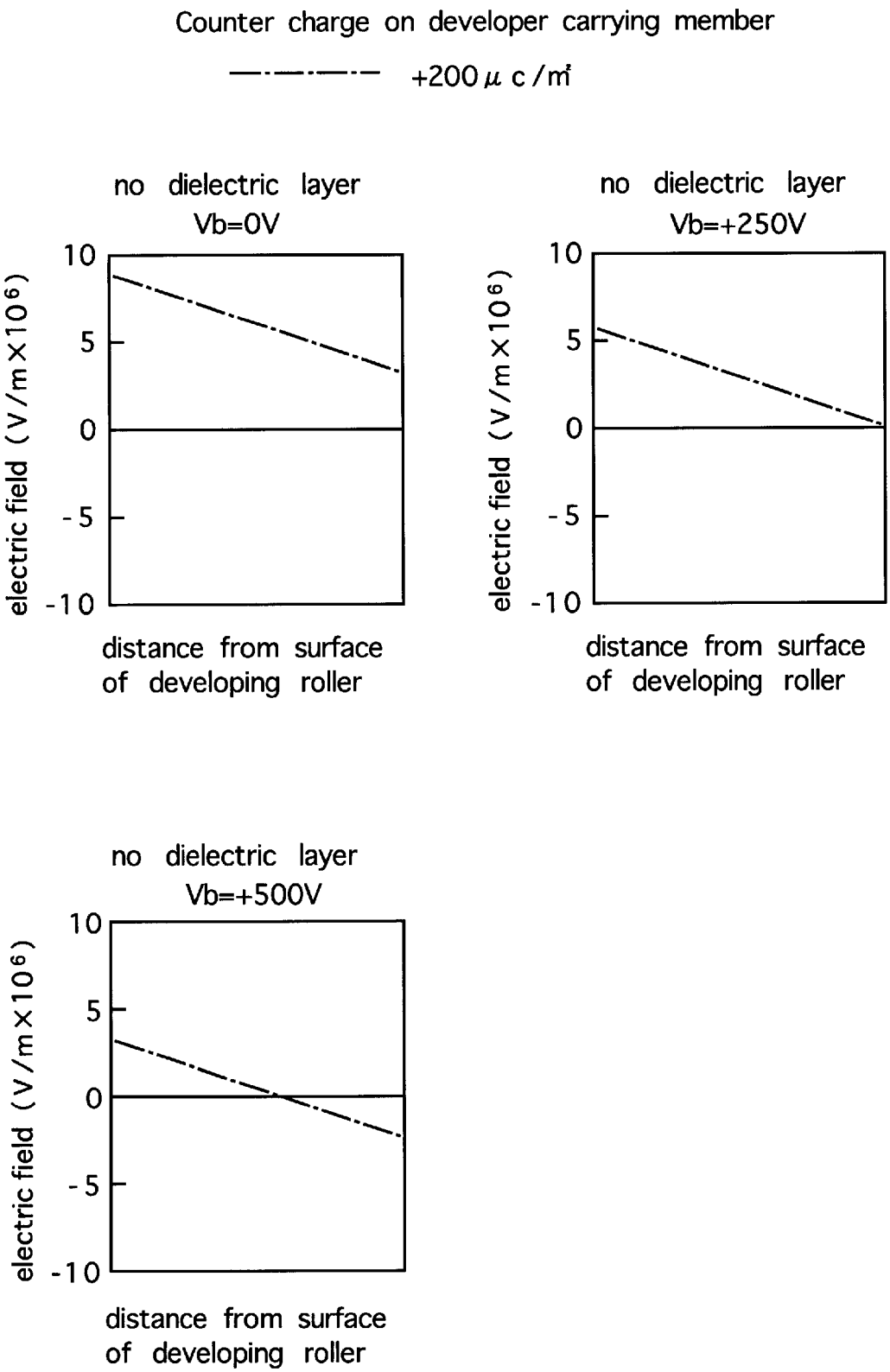
FIG. 4 is a diagram showing, in a case where a regulating member provided with no dielectric layer is used, and DC voltages Vb of 0 V, +250 V, and +500 V are respectively applied to the regulating member in a state where counter charge on the surface of a developer carrying member is +200 $\mu$C/m$^2$, the state of an electric field exerted on a portion between the developer carrying member and the regulating member.

The regulating member 15 provided with no dielectric layer 15*b* was used, and DC voltages Vb of 0 V, +250 V and +500 V were applied to the regulating member 15 from the power supply 16 in a state where the counter charge on the surface of the developer carrying member 11 was +200 $\mu C/m^2$, to find the state of the electric field between the developer carrying member 11 and the regulating member 15. The results thereof were shown in FIG. 4.

As a result, when the DC voltage Vb applied to the regulating member 15 was increased, the electric field was gradually shifted toward the minus side, so that the electric field strength in the vicinity of the surface of the developer carrying member 11 was decreased. Even when the counter charge was +200 $\mu C/m^2$, no leak occurred between the developer carrying member 11 and the regulating member 15.

Figure 5:
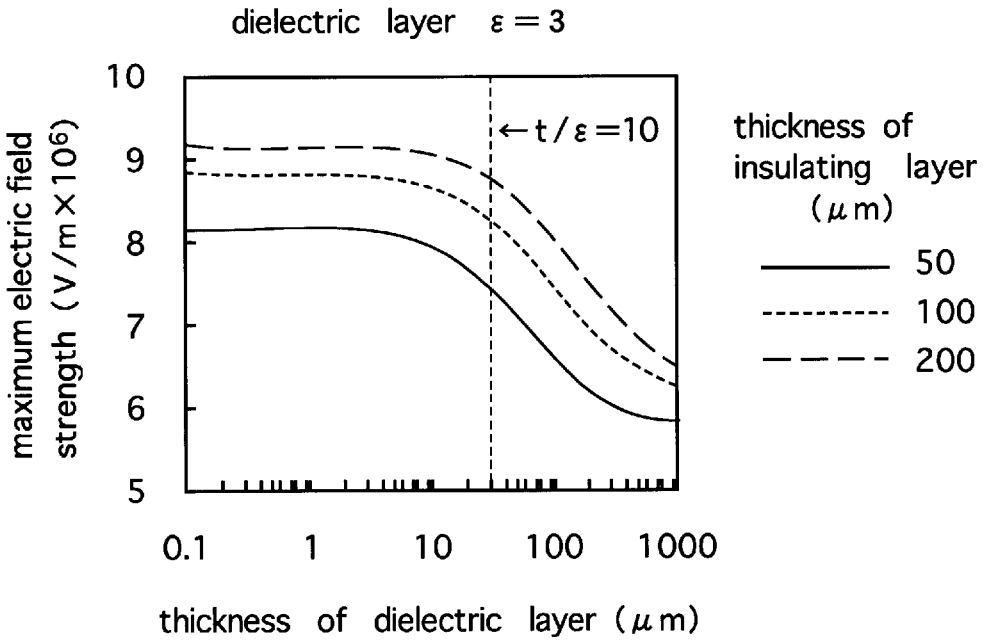
FIG. 5 is a diagram showing the relationship between the thickness t of a dielectric layer and the maximum electric field strength on the surface of a developer carrying member in each of regulating members using materials respectively having relative dielectric constants $\in$ of approximately 3 and 8.
Figure 5:
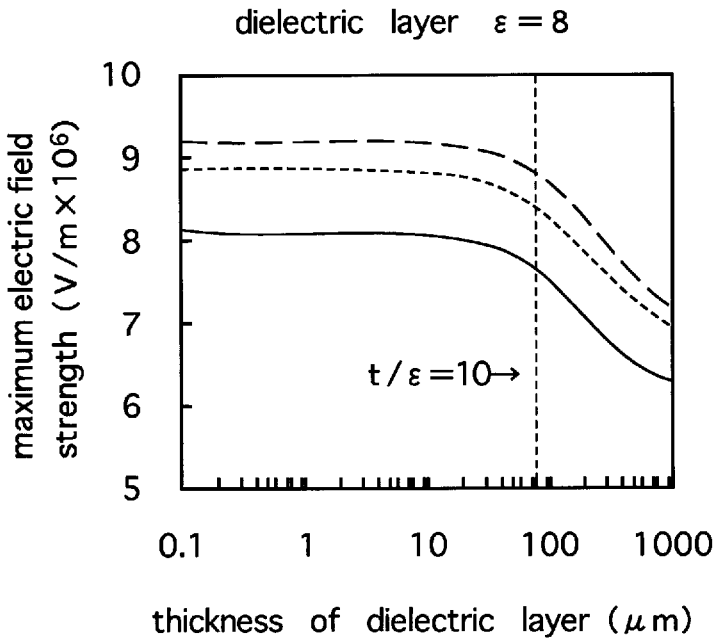

Three types of developer carrying members 11 provided with insulating layers 11*d* whose thicknesses were respectively 50 $\mu$m, 100 $\mu$m, and 200 $\mu$m were then used. The counter charge on the surface of each of the developer carrying members 11 was set to +200 $\mu C/m^2$. On the other hand, examples of the dielectric layer 15*b* in the regulating member 15 were ones respectively having relative dielectric constants $\epsilon$ of approximately 3 and approximately 8. The change in the maximum electric field strength on the surface of the developer carrying member 11 with the change in the thickness t of the dielectric layer 15*b* was found. The results thereof were shown in FIG. 5.

As a result, the maximum electric field strength was decreased as the thickness of the insulating layer 11*d* on the surface of the developer carrying member 11 was decreased. On the other hand, when the thickness t of the dielectric layer 15*b* in the regulating member 15 divided by the relative dielectric constant $\in$ thereof ($t/\in$) was not less than 10 $\mu$m irrespective of the thickness of the insulating layer 11*d*, the maximum electric field strength was rapidly decreased.

As described in the present invention, therefore, when the thickness t of the dielectric layer 15*b* in the regulating member 15 divided by the relative dielectric constant $\in$ thereof was not less than 10 $\mu$m, the maximum electric field strength on the surface of the developer carrying member 11 was decreased, so that a leak was prevented from occurring between the developer carrying member 11 and the regulating member 15.

As the material composing the dielectric layer 15*b*, the above-mentioned thermoplastic styrene elastomer having approximately the same triboelectric charging properties in a triboelectric series as those of the developer 12 and a nylon material having different triboelectric charging properties in a triboelectric series from those of the developer 12 were then used. The dielectric layer 15*b* composed of each of the materials was so provided that the thickness t thereof divided by the relative dielectric constant $\in$ thereof ($t/\in$) was not less than 10 $\mu$m with respect to the electrically conductive member 15*a*.

Each of the regulating members 15 was pressed against the surface of the developer carrying member 11 without applying a DC voltage Vb to a portion between the developer carrying member 11 and the regulating member 15, and the developer carrying member 11 was rotated 10000 times while regulating the developer 12 held on the surface of the developer carrying member 11 by the regulating member 15, to examine a state where the developer 12 is welded to the regulating member 15.

As a result, in the regulating member 15 provided with the dielectric layer 15*b* using the thermoplastic styrene elastomer having approximately the same triboelectric charging properties in a triboelectric series as those of the developer 12, the developer 12 was not welded thereto. On the other hand, in the regulating member 15 provided with the dielectric layer 15*b* using the nylon material having different triboelectric charging properties in a triboelectric series from those of the developer 12, the developer 12 was welded thereto, so that the developer 12 was not uniformly charged or regulated.

Figure 6:
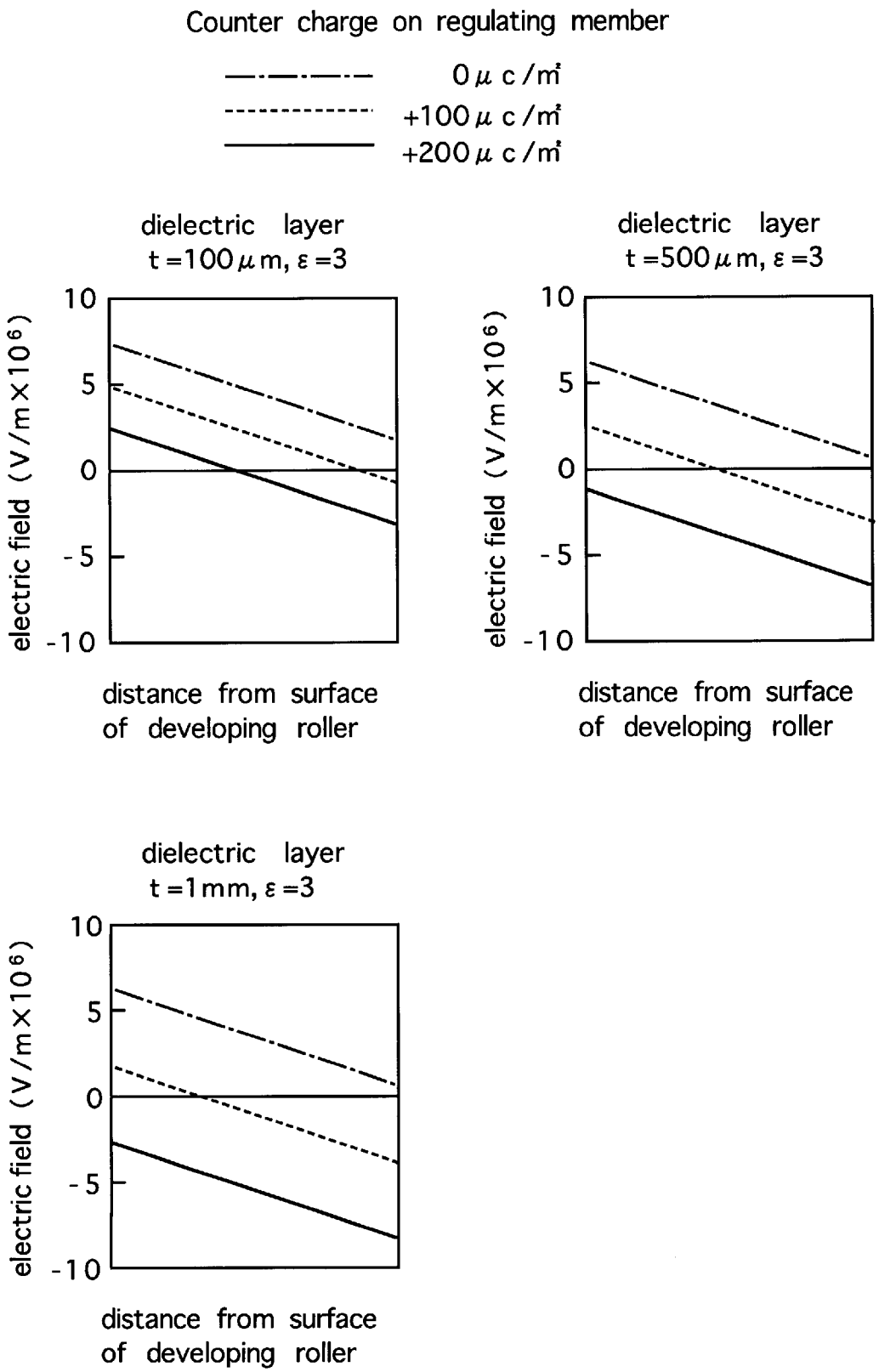
FIG. 6 is a diagram showing, in each of regulating members provided with dielectric layers having a relative dielectric constant $\in$ of approximately 3 and respectively having thicknesses t of 100 $\mu$m, 500 $\mu$, and 1 mm, the state of an electric field exerted on a portion between a developer carrying member and the regulating member in a case where counter charge on the regulating member is changed.

In each of the regulating members 15 provided with the three types of dielectric layers 15*b* having a relative dielectric constant $\in$ of approximately 3 and respectively having thicknesses t of 100 $\mu$m, 500 $\mu$m, and 1 mm in a case where the counter charge on the surface of the developer carrying member 11 was +200 $\mu C/m^2$, when the counter charge was 0 $\mu C/m^2$, +100 $\mu C/m^2$, and +200 $\mu C/m^2$, the state of an electric field between the developer carrying member 11 and the regulating member 15 was found. The results thereof were shown in FIG. 6.

As a result, the electric field strength was shifted toward the minus side as the counter charge in the regulating member 15 was increased. Particularly when the thickness t of the dielectric layer 15*b* was increased, so that the value of $t/\in$ was increased, an electric field in the direction in which the developer 12 is drawn to the regulating member 15 was strongly exerted in the vicinity of the regulating member 6.

As a result, in the case of the regulating member 15 using the nylon material having different triboelectric charging properties in a triboelectric series from those of the developer 12 as a material composing the dielectric layer 15*b* as described above, it was considered that the counter charge was left in the regulating member 15, and the developer 12 was welded upon being drawn to the regulating member 15 by the counter charge.

Therefore, it was preferable that a material having approximately the same triboelectric charging properties in a triboelectric series as those of the developer 12 was used as a material composing the dielectric layer 15*b* in terms of prevention of welding of the developer to the regulating member 15.

When the dielectric layer 15*b* was thus composed of a material having approximately the same triboelectric charging properties in a triboelectric series as those of the developer 12, however, the developer 12 could not be sufficiently frictionally charged by the regulating member 15. Particularly when the developer 12 in large amounts was conveyed, the developer 12 was liable to be insufficiently frictionally charged.

On the other hand, when the dielectric layer 15*b* was composed of a material having different triboelectric charging properties in a triboelectric series from those of the developer 12, for example, the above-mentioned nylon material, the developer 12 could be sufficiently frictionally charged by the regulating member 12. Since the developer 12 was welded to the regulating member 15 as described above, however, the developer 12 had to be prevented from being welded to the regulating member 15 provided with the dielectric layer 15*b*.

In the regulating member 15 composed of the material having different triboelectric charging properties in a triboelectric series from those of the developer 12, an electric field for feeding the developer 12 to the developer carrying member 11 from the regulating member 15 must be exerted to weaken an electric field in the direction in which the developer 12 is drawn to the regulating member 15 in the vicinity of the regulating member 6 in order to prevent the developer from being welded to the regulating member.

As this method, it is considered that a DC voltage Vb having the same polarity as the charging polarity of the developer 12 is applied to the regulating member 15 from the power supply 16.

Figure 7:
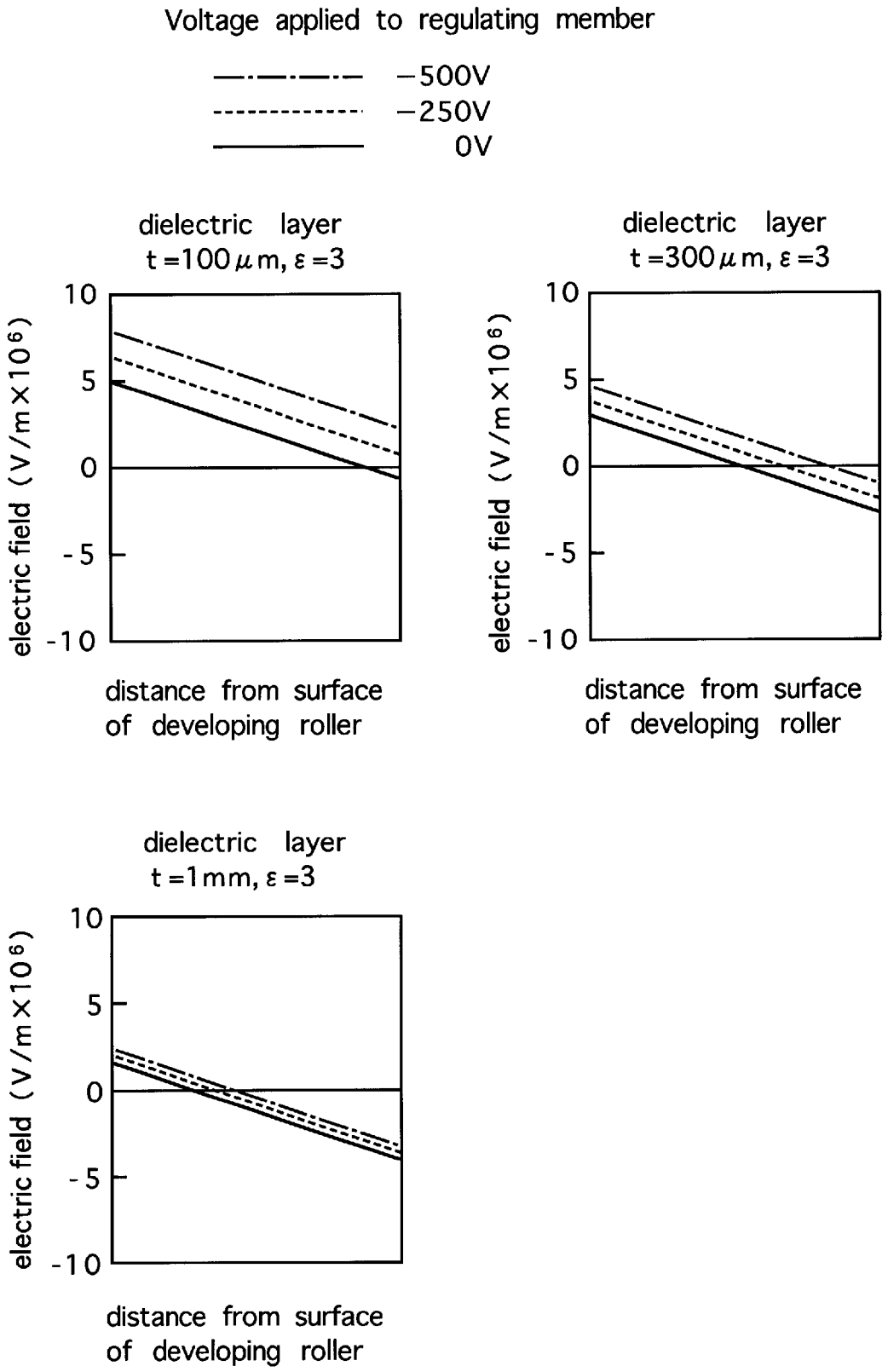
FIG. 7 is a diagram showing, in each of regulating members provided with dielectric layers having a relative dielectric constant $\in$ of approximately 3 and respectively having thicknesses t of 100 $\mu$m, 300 $\mu$m, and 1 mm, the state of an electric field exerted on a portion between a developer carrying member and the regulating member in a case where DC voltages Vb of 0 V, −250 V, and −500 V are respectively applied.

With respect to each of the regulating members 15 provided with the three types of dielectric layers 15*b* having a relative dielectric constant ∈ of approximately 3 and respectively having thicknesses t of 100 μm, 300 μm, and 1 mm, DC voltages vb applied to the regulating member 15 from the power supply 16 were set to 0 C, −250 V, and −500 V in a case where the counter charge on each of the regulating members 15 was +100 $\mu C/m^2$, and the counter charge on the surface of the developer carrying member 11 was +200 $\mu C/m^2$, to find the state of an electric field between the developer carrying member 11 and the regulating member 15. The results thereof were shown in FIG. 7.

As a result, in a case where the thicknesses t of the dielectric layers 15*b* were 100 μm and 300 μm, and the value of t/∈ was not more than 100 μm, when a minus DC voltage Vb having the same polarity as the charging polarity of the developer 12 was applied to the regulating members 15, the electric field strength in the vicinity of each of the regulating member 15 was sufficiently shifted toward the plus side. On the other hand, when the thickness t of the dielectric layer 15*b* was 1 mm, and the value of t/∈ was more than 100 μm, the electric field strength in the vicinity of the regulating member 15 was not sufficiently shifted toward the plus side.

Figure 8:
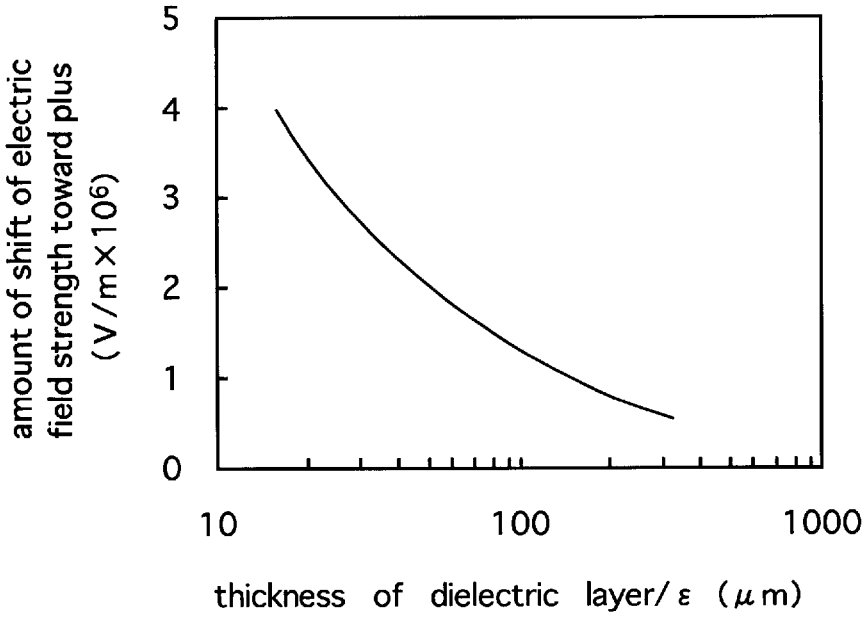
FIG. 8 is a diagram showing the relationship between the amount of shift toward the plus side of the electric field strength and the value of t/$\in$ in a dielectric layer in a case where a DC voltage having the same polarity as the charging polarity of a developer is applied to a developer carrying member.

In a case where the DC voltage Vb having the same polarity as the charging polarity of the developer 12 was applied to the developer carrying member 11 as described above, the relationship between the shift of the electric field strength toward the plus side and the value of t/ϵ in the dielectric layer 15*b* was examined. The results thereof were shown in FIG. 8.

As a result, in a portion where the value of t/ϵ in the dielectric layer 15*b* was not more than 100 μm, the electric field strength was greatly shifted toward the plus side. On the other hand, when the value of t/ϵ was more than 100 μm, the electric field strength was not sufficiently shifted toward the plus side.

A nylon material having a relative dielectric constant ϵ of approximately 3 was used as a material composing the dielectric layer 15*b*, regulating members 15 provided with two types of dielectric layers 15*b* respectively having thicknesses t of 100 μm and 1000 μm were used, and the developer carrying member 11 was rotated 10000 times while regulating the developer 12 held on the surface of the developer carrying member 11 by each of the regulating members 15 as described above in a state where a DC voltage Vb of −500 V was applied to the regulating member 15 from the power supply 16, to examine the state of the developer 12 on the surface of the developer carrying member 11 and a state where the developer 12 was welded to the regulating member 15.

As a result, in a case where the regulating member 15 provided with the dielectric layer 15*b* having a thickness t of 100 μm was used, the developer 12 on the surface of the developer carrying member 11 was not made non-uniform, and the developer 12 was not welded to the regulating member 15. On the other hand, in a case where the regulating member 15 provided with the dielectric layer 15*b* having a thickness t of 1000 μm was used, the developer 12 was welded to the regulating member 15.

From the foregoing results, it was preferable that the developer 12 on the surface of the developer carrying member 11 was uniformly regulated and was sufficiently frictionally charged, a material having different triboelectric charging properties in a triboelectric series from those of the developer 12 was used as a material composing the dielectric layer 15*b* in order to prevent the developer 12 from being welded to the regulating member 15, the relationship between the thickness t of the dielectric layer 15*b* and the relative dielectric constant ∈ thereof was 10 μm≦t/∈≦100 μm, and a voltage was applied to a portion between the developer carrying member 11 and the regulating member 15, to exert an electric field for feeding the developer 12 to the developer carrying member 11 from the regulating member 15.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing device for developing a latent image formed on an image carrying member by a developer, comprising:

a developer carrying member for conveying the developer to a developing area opposite to the image carrying member with it being held on its surface, the developer carrying member having a conductive base substrate and an insulating layer formed on the surface of the conductive base substrate; and a regulating member pressed against the surface of said developer carrying member for regulating the amount of the developer conveyed to the developing area, the regulating member having an electrically conductive member and a dielectric layer formed on the electrically conductive member and pressed against the surface of the developer carrying member, the dielectric layer of said regulating member satisfying the following relationship:

t/∈≧10 μm.

where t (μm) is the thickness of the dielectric layer, and ∈ is the relative dielectric constant of the dielectric layer.

2. The developing device according to claim 1, wherein said developing device performs development using a monocomponent developer containing no carrier particles.

3. The developing device according to claim 1, wherein the dielectric layer of said regulating member is formed of a material having approximately the same triboelectric charging properties in a triboelectric series as those of the developer used in said developing device.

4. The developing device according to claim 1, wherein the dielectric layer of said regulating member is formed of a material having different triboelectric charging properties in a triboelectric series from those of the developer used in said developing device.

5. The developing device according to claim 4, wherein the dielectric layer of said regulating member satisfies the following relationship:

100 μm≧t/ϵ≧10 μm.

6. The developing device according to claim 4, further comprising electric field generating unit for exerting an electric field for feeding the developer from the regulating member to the developer carrying member on a portion between the regulating member and the developer carrying member.

7. A developing device for developing a latent image formed on an image carrying member by a monocomponent developer containing no carrier particles, comprising:

a developer carrying member for conveying the developer to a developing area opposite to the image carrying member with it being held on its surface, the developer carrying member having a conductive base substrate and an insulating layer formed on the surface of the conductive base substrate;

a regulating member pressed against the surface of said developer carrying member for regulating the amount of the developer conveyed to the developing area and frictionally charging the developer, the regulating member having an electrically conductive member and a dielectric layer formed on the electrically conductive member and pressed against the surface of the developer carrying member, the dielectric layer being formed of a material having different triboelectric charging properties in a triboelectric series from those of the developer used in said developing device; and voltage applying unit for applying a voltage to said regulating member so as to exert an electric field for feeding the developer from the regulating member to the developer carrying member on a portion between the regulating member and the developer carrying member, the dielectric layer of said regulating member satisfying the following relationship:

$100\ \mu m \geqq t/\in \geqq 10\ \mu m$.

where t ($\mu$m) is the thickness of the dielectric layer, and $\in$ is the relative dielectric constant of the dielectric layer.

8. A regulating member used for a developing device for conveying a developer to a developing area opposite to an image carrying member with it being held on the surface of a developer carrying member having a conductive base substrate and an insulating layer formed on the surface of the conductive base substrate, and developing a latent image formed on the image carrying member by said developer, comprising:

a first member composed of a dielectric material, the first member being pressed against the surface of the developer carrying member to regulate the amount of the developer conveyed to the developing area and frictionally charge the developer; and a second member having conductive properties for holding said first member, said first member satisfying the following relationship:

$t/\in \geqq 10\ \mu m$ where t ($\mu$m) is the thickness of the first member, and $\epsilon$ is the relative dielectric constant of the first member.

9. The regulating member according to claim 8, wherein said first member is formed of a material having approximately the same triboelectric charging properties in a triboelectric series as those of the developer used in said developing device.

10. The regulating member according to claim 8, wherein the first member is formed of a material having different triboelectric charging properties in a triboelectric series from those of the developer used in said developing device.

11. The regulating member according to claim 10, wherein said first member satisfies the following relationship:

$100\ \mu m \geqq t/\in \geqq 10\ \mu m$.

12. The regulating member according to claim 8, wherein said developing device performs development using a monocomponent developer containing no carrier particles.

13. The regulating member according to claim 8, wherein said second member is formed of stainless or phosphor bronze.

* * * * *